US011261632B2

(12) United States Patent
Czarnota

(10) Patent No.: US 11,261,632 B2
(45) Date of Patent: Mar. 1, 2022

(54) TENSIONING SYSTEM FOR APPLIANCE DOOR

(71) Applicant: Middleby Marshall Inc., Elgin, IL (US)

(72) Inventor: Anthony Czarnota, Cary, NC (US)

(73) Assignee: Middleby Marshall Inc., Elgin, IL (US)

( * ) Notice: Subject to any disclaimer, the term of this patent is extended or adjusted under 35 U.S.C. 154(b) by 0 days.

(21) Appl. No.: 17/032,274

(22) Filed: Sep. 25, 2020

(65) Prior Publication Data

US 2021/0095508 A1 Apr. 1, 2021

Related U.S. Application Data

(60) Provisional application No. 62/908,693, filed on Oct. 1, 2019.

(51) Int. Cl.
*E05D 13/00* (2006.01)

(52) U.S. Cl.
CPC .... *E05D 13/1207* (2013.01); *E05Y 2201/654* (2013.01); *E05Y 2201/668* (2013.01); *E05Y 2900/304* (2013.01); *E05Y 2900/306* (2013.01); *E05Y 2900/308* (2013.01); *E05Y 2900/31* (2013.01); *E05Y 2900/312* (2013.01)

(58) Field of Classification Search
CPC ..... E05D 13/1207; E05Y 2201/654; E05Y 2201/668; E05Y 2900/304; E05Y 2900/306; E05Y 2900/308; E05Y 2900/31; E05Y 2900/312
See application file for complete search history.

(56) References Cited

U.S. PATENT DOCUMENTS

| | | | | |
|---|---|---|---|---|
| 433 A | 10/1837 | Richardson | | |
| 1,963,388 A * | 6/1934 | Smith | F24C 15/023 | 126/194 |
| 3,049,114 A * | 8/1962 | Carnahan | F24C 15/023 | 126/191 |
| 5,980,006 A * | 11/1999 | Wilhelmstatter | A47L 15/4261 | 126/191 |

(Continued)

FOREIGN PATENT DOCUMENTS

| | | |
|---|---|---|
| CN | 103 821 420 A | 5/2014 |
| DE | 2424288 | 12/1974 |

(Continued)

OTHER PUBLICATIONS

Search Report and Written Opinion for PCT/US2020/052715, dated Dec. 11, 2020, 10 pp.

*Primary Examiner* — Daniel J Rohrhoff
(74) *Attorney, Agent, or Firm* — Crowell & Moring LLP

(57) ABSTRACT

A door tensioning system for an oven or other appliance includes a chain and spring assembled as a pull member attached at one end to a door and at an opposite end to a base member of the appliance in a manner maintaining spring-mediated tension between the door and the base/bulk of the appliance. The pull member is routed around a bracket-assembly-mounted pulley, where the bracket assembly includes at least one movable bracket member that is movable with the pulley in a manner that will increase or decrease tension in the pull member by increasing/decreasing its effective length between its ends.

20 Claims, 7 Drawing Sheets

(56) References Cited

U.S. PATENT DOCUMENTS

| | | | | |
|---|---|---|---|---|
| 5,988,933 | A * | 11/1999 | Wilhelmstatter | A47L 15/4261 403/381 |
| 7,862,132 | B2 | 1/2011 | Tynes et al. | |
| 8,042,891 | B2 | 10/2011 | Tynes et al. | |
| 8,292,381 | B2 | 10/2012 | McDaniel et al. | |
| 8,393,691 | B2 | 3/2013 | Diebold et al. | |
| 8,944,530 | B2 | 2/2015 | Haft et al. | |
| 9,155,444 | B2 * | 10/2015 | Lee | A47L 15/4261 |
| 9,498,102 | B2 * | 11/2016 | Chae | E05D 7/00 |
| 2008/0122331 | A1 * | 5/2008 | Haeberle | A47L 15/4261 312/319.1 |
| 2009/0072686 | A1 * | 3/2009 | Vooren | A47L 15/4261 312/319.4 |
| 2011/0241507 | A1 * | 10/2011 | Diebold | A47L 15/4261 312/228 |
| 2012/0060323 | A1 * | 3/2012 | Lee | E05D 15/582 16/275 |
| 2013/0063011 | A1 * | 3/2013 | Kozinski | A47L 15/4261 312/319.2 |
| 2014/0375192 | A1 * | 12/2014 | Haft | E05D 13/1207 312/319.2 |
| 2016/0029873 | A1 * | 2/2016 | Ucar | A47L 15/4261 49/386 |
| 2018/0044960 | A1 * | 2/2018 | Saylor | E05F 1/1075 |

FOREIGN PATENT DOCUMENTS

| | | |
|---|---|---|
| EP | 0 392 588 | 4/1990 |
| EP | 1 402 809 A2 | 3/2004 |

* cited by examiner

TENSIONING SYSTEM FOR APPLIANCE DOOR

CROSS-REFERENCE TO RELATED APPLICATION

This application is a non-provisional application which claims priority to U.S. provisional application Ser. No. 62/908,693, filed Oct. 1, 2019, which is incorporated by reference herein in its entirety.

TECHNICAL FIELD

Embodiments disclosed herein generally relate to tension control mechanisms for appliance doors. More particularly embodiments herein relate to tensioning for a door of an oven or other appliance.

BACKGROUND

Commercial and home ranges commonly include an oven door that is vertical when closed and opens to parallel or nearly parallel with the floor. Many other appliances include similar door construction including, for example, certain dishwashers and clothes dryers. A variety of mechanisms have been developed to provide a desirable balance between the door staying open to desired angle(s) and maintaining a preferred sealing contact with the appliance body—with or without a closing clamp. The open and closed positions are arrived at and maintained through a variety of techniques, including one or more of the following: compression springs, extension springs, counterweights, chain drive, and gears between the body of the appliance and its door. For embodiments with one or more springs, the spring tension or compression may alter over time and usage and need to be adjusted (e.g., due to relaxation of the spring and/or other factors) in order to maintain desired tension relative to the door.

As shown in FIG. 1, which illustrates a general image of an oven range 90 including a call-out detail of an internal door-tensioning system, many prior art systems use a turnbuckle assembly 91 or similar structure to adjust tension of extension spring(s) 92 that are attached to the door 93 (directly and/or via hinges, not shown). This system adjusts tension in-line with the spring(s) by moving one or more nuts 94 along a threaded shaft portion 95 to stretch or relax the spring(s). One advantage of extension spring mechanisms of this type is ready access to the spring for service. Spring failure can be addressed with removal and replacement without replacing the rest of the mechanism.

An intermediate failure mode occurs when the extension spring(s) will still open and close the door, but without the desired force. This may be due to manufacturing error, or a relaxation of the spring. If too much tension is present, the door will attempt to close itself from the open position. And, if too little tension is present, the door won't close solidly, resulting in a gap around the door, that—in an oven—allows heat to leak out and can cause component failure and/or compromise oven performance (e.g., due to requirement for multiple sensor-activated heating cycles greater than with a fully-closed door that increases wear on sensors, heating elements, and other components). However, it has been found that such turnbuckle systems can introduce torque and/or twist in the system, which can increase the risk of spring failure (e.g., in a number of cycles associated with oven door use). Accordingly, it is desirable to provide an effective spring-tensioning system that provides advantageous features known for spring-tensioned appliance doors, but that further provides means for adjusting tension without increasing risk of partial/intermediate or complete spring failure associated with prior art turnbuckle-type systems.

BRIEF SUMMARY

In one aspect, embodiments disclosed herein may include a tensioning system for a door of an appliance, where that system includes: a first bracket defining a raceway; a second bracket disposed in the first bracket raceway, where the first bracket is movable relative to the second bracket, and/or the second bracket is movable relative to the first bracket, and said movability is mediated along an adjustment axis by an adjustment member contacting both the first bracket and the second bracket; a pulley disposed in a raceway of the second bracket, where the pulley is rotatably mounted to one of the first bracket or the second bracket and is slidably attached to the other of the first bracket or the second bracket, where rotation of the pulley is around a pulley axis that is orthogonal to the adjustment axis, and slidable movement of the pulley is along the adjustment axis; and a pull member, including a first pull member end opposite a second pull member end, disposed to provide pull member tension between the first and second pull member ends, where the pull member includes at least one spring and at least one pull member surface between the ends, with said pull member surface contacting at least a portion of the pulley such that movement of the pulley along the adjustment axis increases or decreases said tension.

In another aspect, embodiments disclosed herein may include an adjustable spring-tension system for an appliance door, said system comprising: a pull member including an expansion spring between a first pull member end and a second pull member end, where the first pull member end is configured for direct or indirect attachment to an appliance door and the second pull member end is configured for attachment to a base portion of an appliance; a pulley including an external circumferential surface in contact with at least a lengthwise portion of the pull member between the first and second pull member ends, where the pulley is rotatably mounted in a channel of an inner bracket; and an outer bracket including a raceway defined on two sides by opposed walls, where the inner bracket is mounted in the raceway and is movable along a track in at least one of said opposed walls; where movement of the inner bracket relative to the outer bracket is effected by operation of a threaded member contacting both brackets, and where a range of said movement is limited by a length of the track and by operation of the threaded member along a tension adjustment axis that is perpendicular to a rotation axis of the pulley.

In certain embodiments, an appliance is claimed including an adjustable spring-tensioned door mechanism, but an entire appliance is not claimed unless expressly positively recited because other claims are just for a tensioning system useful in an appliance that is not claimed but referred to only in the abstract by way of a reference for attachment points and relative positioning of the claimed system. By way of example that does positively recite an entire appliance, some embodiments may include an oven with a door-tensioning system, where the oven includes: a door mounted by a door hinge to an oven body; where the door-tensioning system is disposed in the oven body, and that door tensioning system comprises: a first bracket defining a raceway; a second bracket disposed in the first bracket raceway, where the first bracket is movable relative to the second bracket, or the second bracket is movable relative to the first bracket, and said movability is mediated along an adjustment axis by an adjustment member attached to both the first bracket and the second bracket; where a selected one of the first or second bracket that is not movable relative to the other of the first or second bracket is mounted to the oven body; a pulley disposed in a raceway of the second bracket, where the pulley is rotatably mounted to one of the first bracket or the second bracket and is slidably attached to the other of the first bracket or the second bracket, where rotation of the pulley is around a pulley rotation axis that is orthogonal to the adjustment axis, and slidable movement of the pulley is along the adjustment axis; and a pull member, including a first pull member end attached to the door hinge opposite a second pull member end attached to the oven body, where the pull member includes an expansion spring providing tension between the first and second pull member ends and includes at least one pull member surface between the pull member ends, with said pull member surface contacting at least a portion of the pulley such that movement of the pulley along the adjustment axis in a first direction increases said tension and movement of the pulley along the adjustment axis in a second direction decreases said tension.

DETAILED DESCRIPTION

Figure 1:
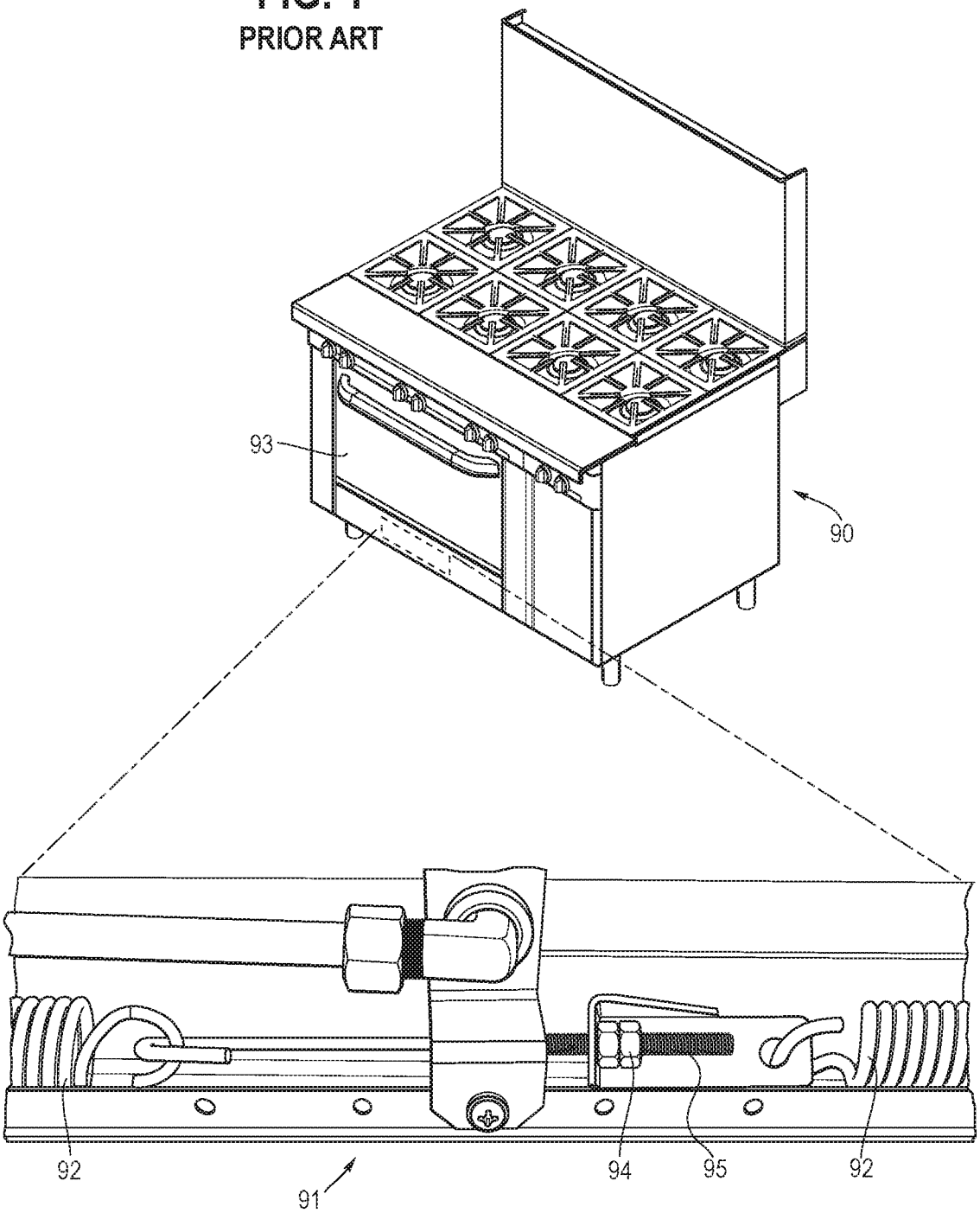
FIG. 1 PRIOR ART
FIG. 1 shows a prior art oven range including a detail/magnified call-out of a turnbuckle-type spring tensioning mechanism for an appliance door.

Various embodiments are described below with reference to the drawings in which like elements generally are referred to by like numerals. The relationship and functioning of the various elements of the embodiments may better be understood by reference to the following detailed description. However, embodiments are not limited to those illustrated in the drawings. It should be understood that the drawings are not necessarily to scale, and in certain instances details may have been omitted that are not necessary for an understanding of embodiments disclosed herein, such as—for example—conventional fabrication and assembly.

Generally, embodiments described here include a static bracket member and a movable bracket member, where the movable bracket member provides for movement of a pulley in contact with a pull member that is held in spring-mediated tension. Movement of the bracket and pulley increases or decreases tension between ends of the pull member, which ends are attached, respectively, to a door and a base member of an appliance, where opening the door pulls on/extends the spring of the pull member. The movable bracket preferably is adjusted/moved by a threaded shaft that contacts the movable bracket and the static bracket.

The invention is defined by the claims, may be embodied in many different forms, and should not be construed as limited to the embodiments set forth herein; rather, these embodiments are provided so that this disclosure will be thorough and complete, and will fully convey enabling disclosure to those skilled in the art. As used in this specification and the claims, the singular forms "a," "an," and "the" include plural referents unless the context clearly dictates otherwise. Reference herein to any industry standards (e.g., ASTM, ANSI, IEEE standards) is defined as complying with the currently published standards as of the original filing date of this disclosure concerning the units, measurements, and testing criteria communicated by those standards unless expressly otherwise defined herein.

The terms "about," "substantially," "generally," and other terms of degree, when used with reference to any volume, dimension, proportion, or other quantitative or qualitative value, are intended to communicate a definite and identifiable value within the standard parameters that would be understood by one of skill in the art (equivalent to a mechanical engineer with experience in any field related to spring-tensioned structures), and should be interpreted to include at least any legal equivalents, minor but functionally-insignificant variants, standard manufacturing tolerances, and including at least mathematically significant figures (although not required to be as broad as the largest range thereof). Although the present embodiments are described primarily with reference to commercial oven door tensioning systems, they are not limited to ovens and will be appreciated by those of skill the art as being applicable to other appliances and/or objects with a door that opens from a generally vertical position downward to/toward a more horizontal position. Commercial ovens with door(s) of this type are often built for heavy duty use, including having a door and opening system that is strong enough for a person to stand on the door, as that may occur during use in environments where a person uses the door as a step/stool to access, for example, a vent above an oven/range for cleaning purposes.

Figure 2A:
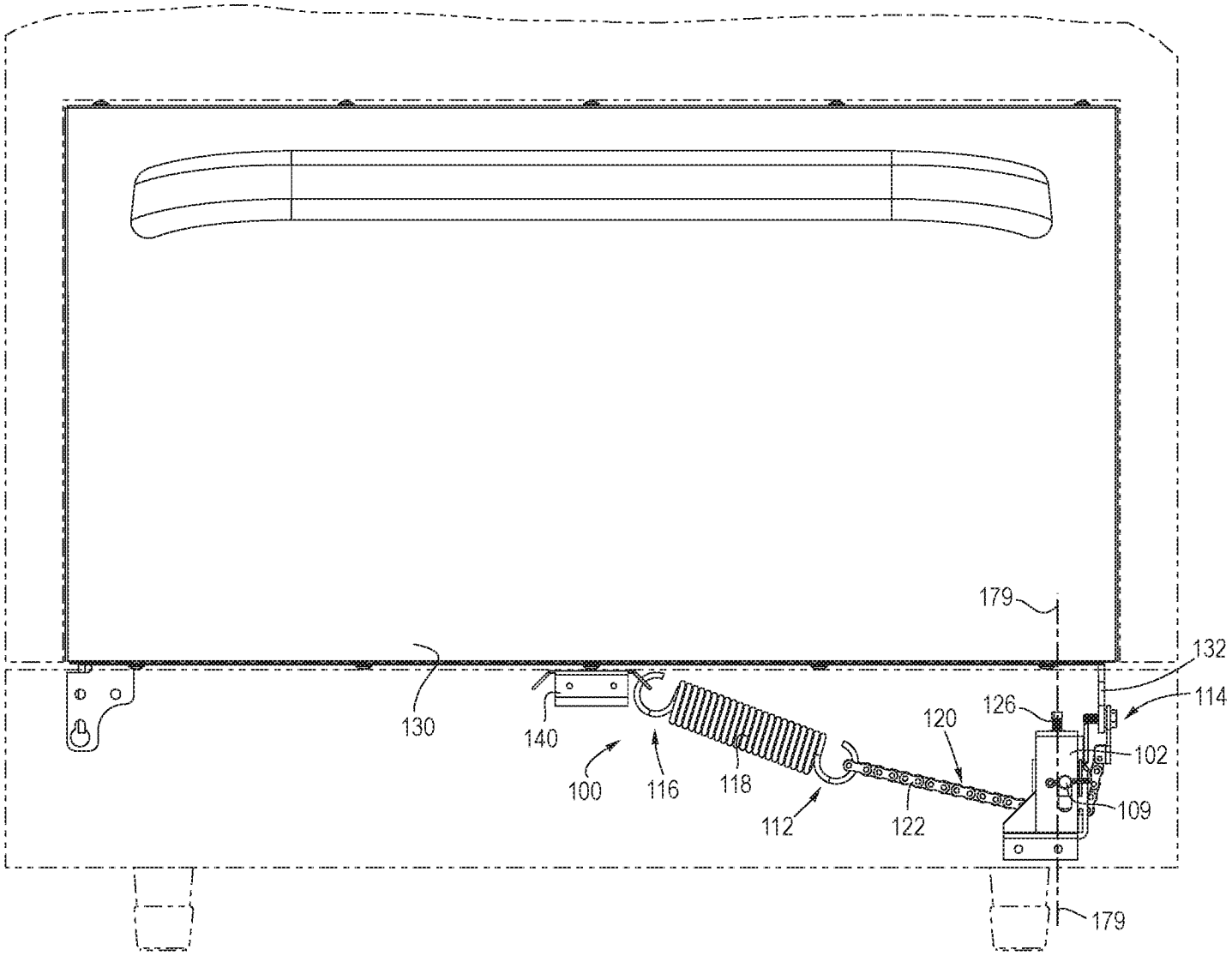
FIGS. 2A-2G illustrate a spring tensioning mechanism according to presently disclosed embodiments including a front elevation view and side elevation view with a closed door (in FIGS. 2A and 2B, respectively), a front elevation view and side elevation view with an open door (in FIGS. 2C and 2D, respectively), a front perspective view of an inner/outer bracket assembly of the system (in FIG. 2E), a partial front elevation view of the system (in FIG. 2F), and a diagrammatic side elevation view showing forces of the pull member and movement of one bracket component relative to another bracket component.
Figure 2B:
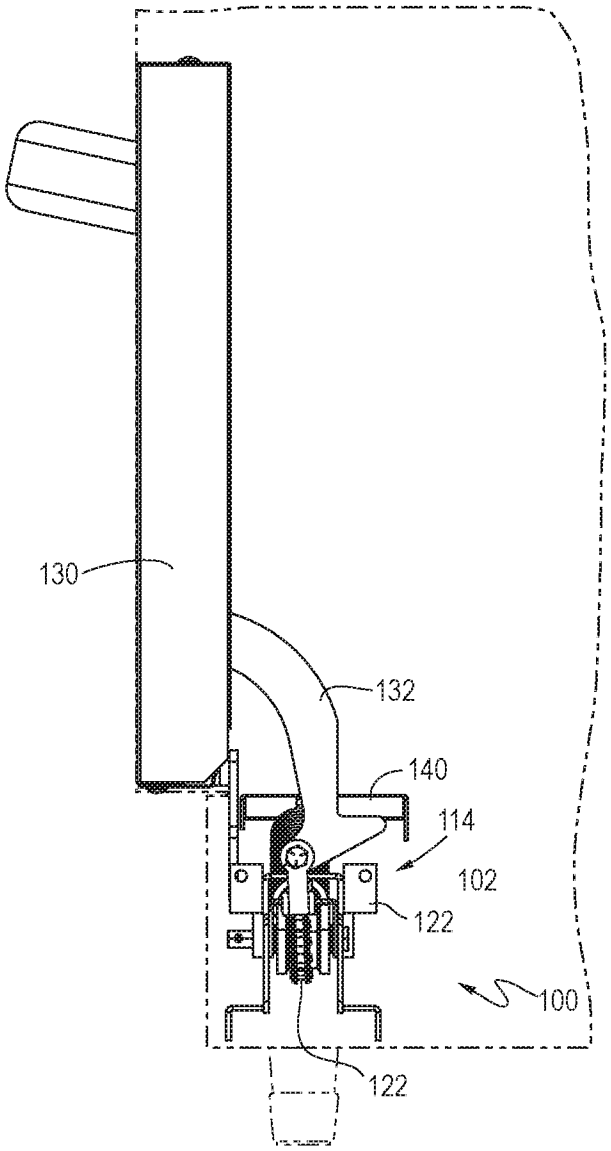

One embodiment of an adjustable spring-tension system for an appliance door is described with reference to FIGS. 2A-2G, where many such systems will actually include two of each described element—mounted in connection with opposite-side hinges and/or other door structures. The bracket and pulley assemblies of FIGS. 2E and 2F are generally mirror images of each other, illustrating how brackets at opposite sides of an appliance door may be embodied. Likewise, FIGS. 2A-2B show only a single system embodiment 100 with an appliance door 130, but it should be appreciated that a generally mirror-image assembly may be provided at the left end of the door 130 (as viewed in FIG. 2A).

In this embodiment, shown in perspective view in FIG. 2E, an outer first bracket 102 has a box-like inverted U-shape that defines a raceway 104. An inner second bracket 106 is disposed movably in the first bracket's raceway 104, while the outer bracket 102 is fixed relative to the appliance. In this embodiment, the inner bracket 106 is movable relative to the outer bracket 102. The movability of the inner bracket 106 is mediated along an adjustment axis 179 by an adjustment member 126 (embodied here as a threaded bolt/tensioning screw) that threadedly passes through the outer bracket and contacts an upper surface of the inner bracket 106. The threaded member 126 may also engage a nut 128. Rotating the threaded member 126 in a first direction will push the inner bracket 106 downward into/against the spring-tension of the pull member 112 (tighter), while rotating it the opposite direction will allow that spring tension to direct the inner bracket 106 upward (looser).

A pulley 108 is disposed transversely in and across a raceway 110 of the inner bracket 106. The pulley 108 is rotatably mounted around a pulley axle 109 that extends through at least one of the paired side walls of the inner bracket 106. One or both ends of the pulley axle 109 extend through track(s) 187 that are formed as aperture(s) in the side wall(s) of the outer bracket 102 so that the pulley is slidably attached to the outer bracket. Rotation of the pulley 108 is around a pulley axis 189 (that is coaxial with the axle 109 and orthogonal to the adjustment axis 179) such that the slidable movement of the pulley 108 is oriented along, parallel, or nearly parallel with the adjustment axis.

As shown in FIGS. 2A-2D and 2F, the pull member 112 is illustrated here as including a chain 122 and spring 118, with a first end 114 opposite a second end 116. In other embodiments the pull member may include a chain, wire, polymer rope or cable, metal cable, strap, tape, any similar structure, and/or any combination thereof. The pull member 112 is disposed so as to provide pull member tension between the first and second pull member ends by operation of the spring 118. At least one pull member surface 120 contacts a portion of the pulley 108 in a manner such that movement of the pulley 108 along the adjustment axis 179 increases or decreases said tension between the ends 114, 116. In the embodiment of FIGS. 2A-2G, the first end 114 is attached to a base member or other static anchor 140 of the appliance, and the second end 116 is attached to a door 130 of the appliance, which may be done directly, but which is illustrated here as being connected via a hinge member 132. The tension/forces are diagrammatically shown in FIG. 2G, which illustrates the opposing forces of the tension of the pull member toward the door 130 ($F_{DOOR}$) and along the spring toward the base member 140 ($F_{SPRING}$), while the tension can be increased or decreased by adjusting the inner bracket 106 along a desired travel distance ($D_{TRAVEL}$) along the adjustment axis 179. In the illustrated embodiment, adjustment downward of the inner bracket 106 will increase tension along the pull member 112 by increasing the effective distance therealong between its ends 114, 116 and stretching the spring 118, while adjustment upward will decrease tension.

Figure 2C:
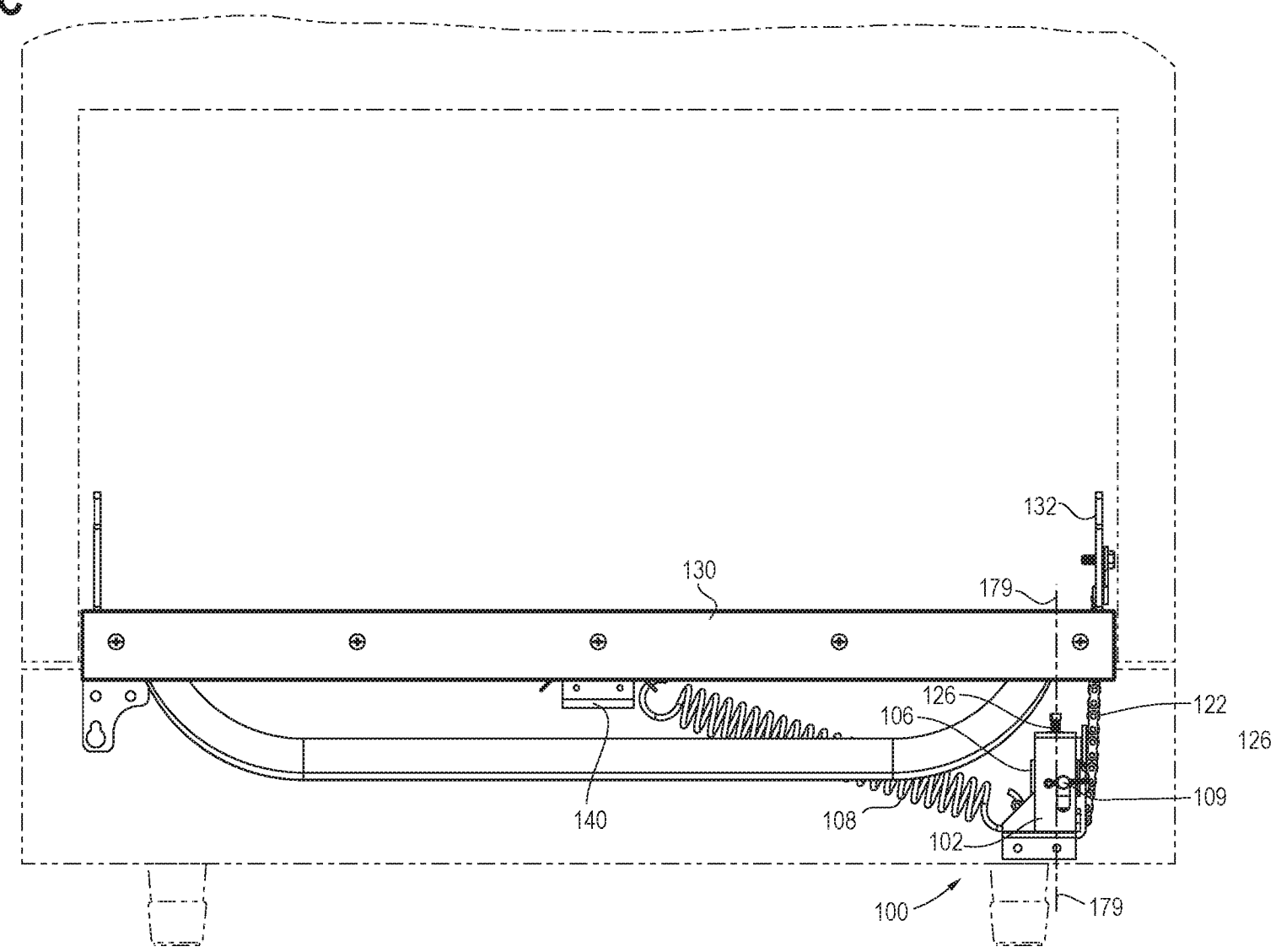
Figure 2D:
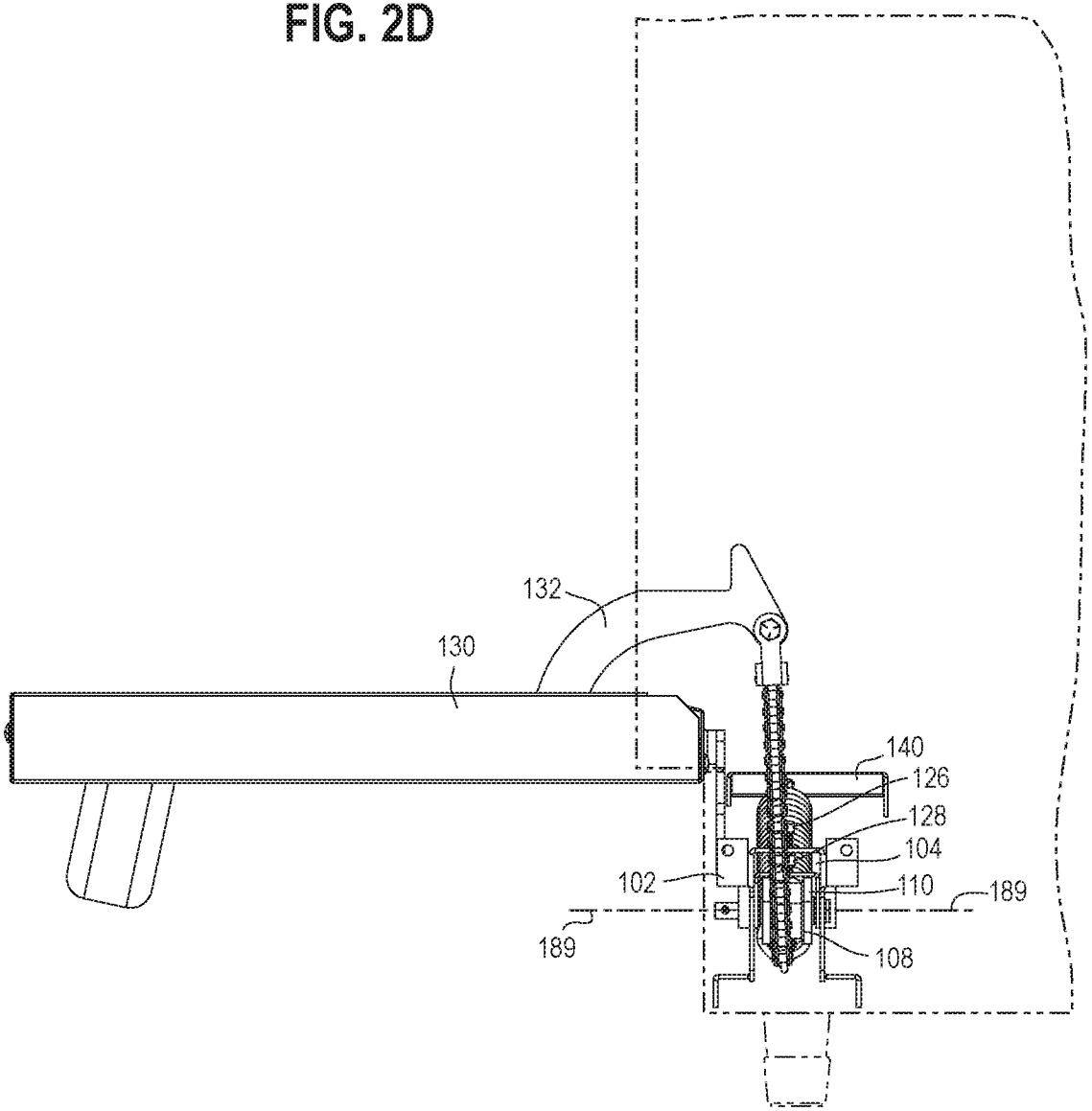
Figure 2F:
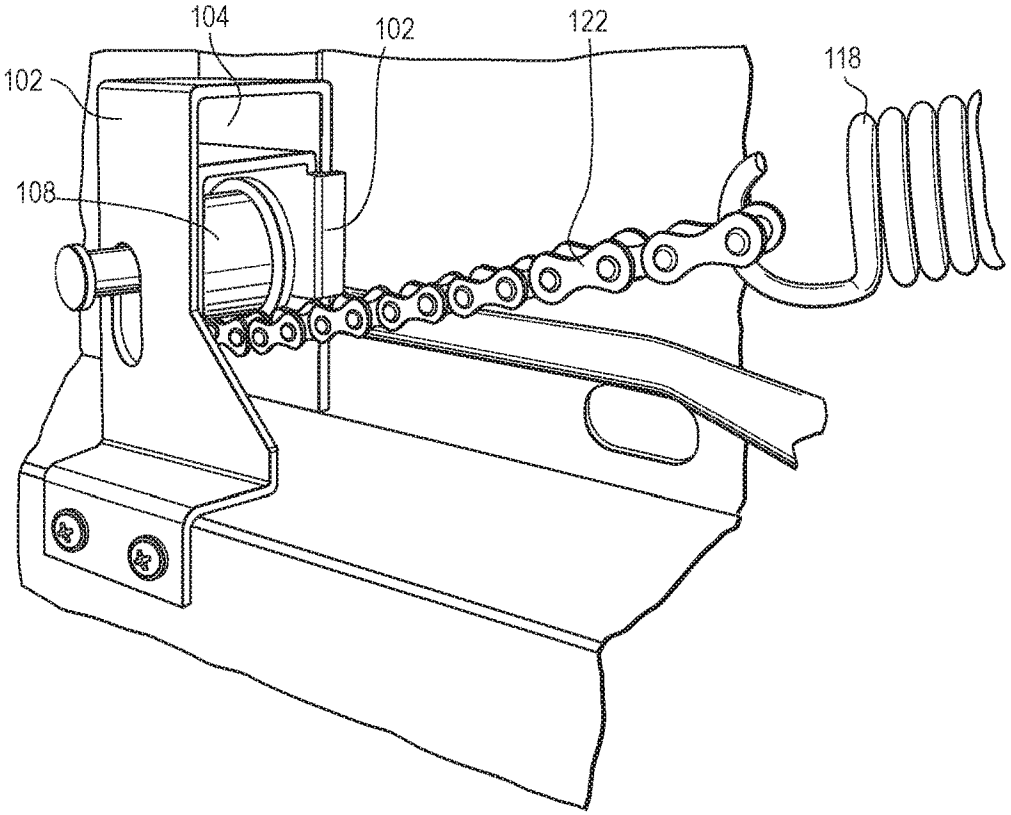
Figure 2E:
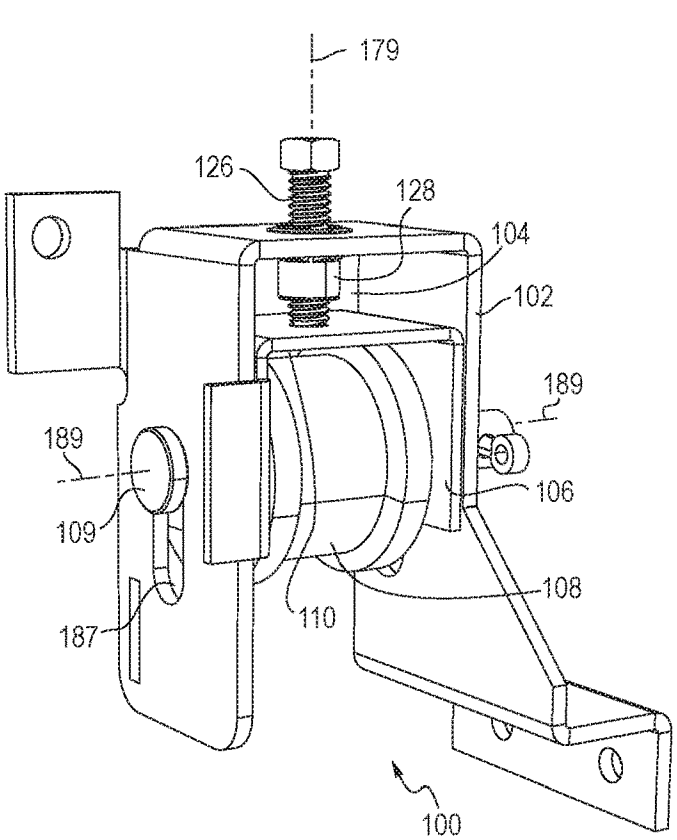

Operation of the system 100 will be appreciated with comparative reference of FIGS. 2A-2B with FIGS. 2C-2D. FIGS. 2A-2B show, respectively, a front and side view of the appliance door 130 in a vertical (closed) position, while FIGS. 2C-2D show, respectively, a front and side view of the appliance door 130 in a horizontal (open) position. As shown in FIGS. 2A-2B, when the door is closed the spring 118 is more relaxed, although it preferably still maintains a desired tension along the pull member 112. For an oven, this desired tension preferably maintains a seal between the door 130 and oven body (not shown) that prevents undesirable heat leakage that can reduce energy efficiency and can cause increased cycling and wear of oven heating elements. As shown in FIGS. 2C-2D, when the door is open, the spring 118 is more extended, but the present system and any intervening element(s) (e.g., hinge element 132) are configured as known in the art to maintain an open position of the door, which may further include additional elements not presently described but well understood by those skilled in the relevant arts. At least one lengthwise portion of the pull member 112 may be disposed parallel or nearly parallel (within 30 degrees, preferably within 20 degrees, and more preferably within 10 degrees) relative to the adjustment axis 179, which adjustment axis is shown in the drawings as being vertical. In the side elevation view of FIGS. 2B and 2D, a non-limiting example of an oven body structure is shown in phantom lines in order to more clearly illustrate the embodiment with perspective to a potential embodiment with an oven door.

Figure 3:
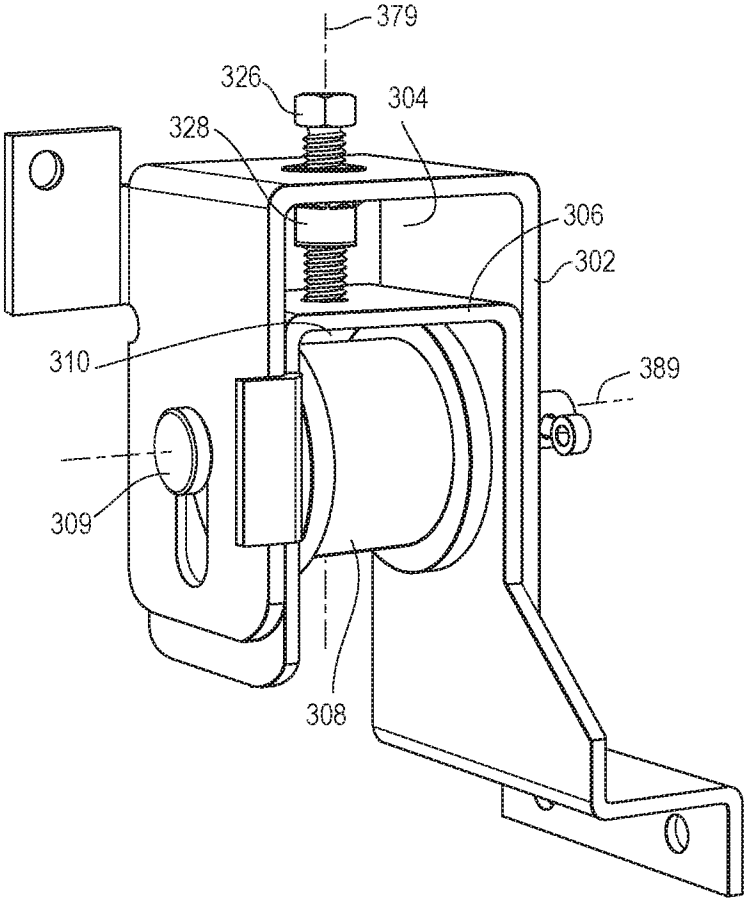
FIG. 3 shows a perspective view of a different bracket embodiment.
Figure 2G:
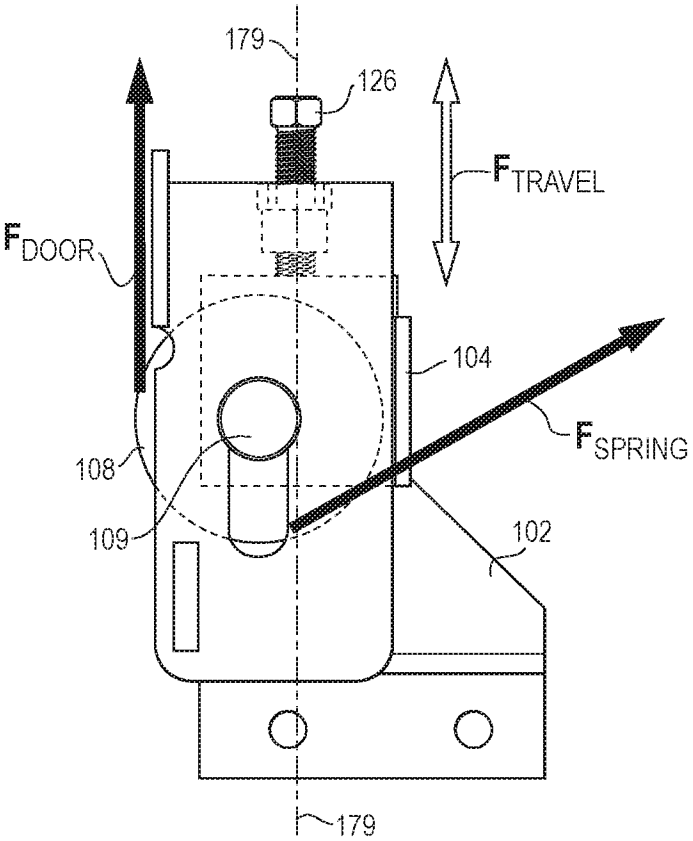

FIG. 3 shows a different bracket embodiment, where an inner bracket 306 is static and configured to be mounted to an appliance base (like the outer bracket 102 of FIGS. 2A-2G). An outer first bracket 302 has a box-like inverted U-shape that defines a raceway 304. An inner second bracket 306 is disposed in the first bracket's raceway 304 and is fixed relative to the appliance, while the outer bracket 302 is movable relative to the inner bracket 306. The movability of the outer bracket 302 is mediated along an adjustment axis 379 by an adjustment member 326 (embodied here as a threaded bolt/tensioning screw) that threadedly passes through the outer bracket and contacts an upper surface of the inner bracket 306. The threaded member 326 may also engage a nut 328. Rotating the threaded member 326 in a first direction will push the outer bracket 302 (and pulley 308 mounted thereto) downward into/against the spring-tension of a pull member (tighter), while rotating it the opposite direction will allow that spring tension to direct the outer bracket 302 upward (loosening the spring tension by decreasing the effective length between ends of the pull member including the spring).

The pulley 308 is disposed transversely in and across a raceway 310 of the inner bracket 306. The pulley 308 is rotatably mounted around a pulley axle 309 that extends through a track or other aperture in one or both of the side walls of the inner bracket 306. One or both ends of the pulley axle 309 are rotatably attached to the outer bracket 302. Rotation of the pulley 308 is around a pulley axis 389 (that is coaxial with the axle 309 and orthogonal to the adjustment axis 379) such that the slidable movement of the pulley 308 is oriented along or parallel with the adjustment axis, and is generally vertical in the embodiment as illustrated, although the orientation of this axis can change if the brackets are mounted elsewhere in an appliance. In this and other embodiments the bracket fixed rotatably to the pulley preferably is movable relative to the other bracket that is fixed to the appliance base or other appliance portion suitable for anchoring the pull member. However, that latter bracket may also be configured as being adjustable relative to the appliance base or other portion to which it is anchored in order to prove additional means for changing tension along the pull member in keeping with principles of the present disclosure, and those adjustability means may include having one or more adjustment members like the threaded member 126/326 configured with that appliance-attached bracket to adjust its position relative to the bulk of the appliance in a manner adjusting pull member tension, which will be understood by those skilled in the art with reference to the present disclosure.

Those of skill in the art will appreciate that embodiments not expressly illustrated herein may be practiced within the scope of the claims, including that features described herein for different embodiments may be combined with each other and/or with currently-known or future-developed technologies while remaining within the scope of the claims. These embodiments maybe useful in one or more of an oven, a dishwasher, a refrigerator, a clothes dryer, a freezer, and/or any other appliance with a similar door for which tensioned closure is desirable. Although specific terms are employed herein, they are used in a generic and descriptive sense only and not for purposes of limitation unless specifically defined by context, usage, or other explicit designation. It is therefore intended that the foregoing detailed description be regarded as illustrative rather than limiting. And, it should be understood that the following claims, including all equivalents, are intended to define the spirit and scope of this invention. Furthermore, the advantages described above are not necessarily the only advantages of the invention, and it is not necessarily expected that all of the described advantages will be achieved with every embodiment. In the event of any inconsistent disclosure or definition from the present application conflicting with any document incorporated by reference, the disclosure or definition herein shall be deemed to prevail.

I claim:

1. A tensioning system for a door of an appliance, said system comprising:

a first bracket defining a raceway;

a second bracket disposed in the first bracket raceway, where the first bracket is movable relative to the second bracket, and/or the second bracket is movable relative to the first bracket, and said movability is mediated along an adjustment axis by an adjustment member contacting the first bracket and abutting the second bracket;

a pulley disposed in a raceway of the second bracket, where the pulley is rotatably mounted to one of the first bracket or the second bracket and is slidably attached to the other of the first bracket or the second bracket, where rotation of the pulley is around a pulley axis orthogonal to the adjustment axis, and slidable movement of the pulley is along the adjustment axis; and a pull member, including a first pull member end opposite a second pull member end, disposed to provide pull member tension between the first and second pull member ends, and including a spring and at least one pull member surface between the ends, with said pull member surface contacting at least a portion of the pulley such that movement of the pulley along the adjustment axis increases or decreases said tension.

2. The tensioning system of claim 1, wherein the first bracket is fixed, and the second bracket is movable relative to the first bracket, or the second bracket is fixed, and the first bracket is movable relative to the second bracket.

3. The tensioning system of claim 1, wherein the pull member includes a chain, a wire, a polymer rope, a metal cable, a strap, a tape, or any combination thereof.

4. The tensioning system of claim 1, wherein the adjustment member is threadedly engaged with the first bracket in a manner configured to move the second bracket along the adjustment axis when the adjustment member is rotated around the adjustment axis.

5. The tensioning system of claim 1, wherein the first pull member end is attached to a door of an appliance, a second pull member end is attached to a base member of the appliance, and at least one of the first bracket and the second bracket is attached to the base member of the appliance.

6. The tensioning system of claim 5, wherein the first pull member end is attached directly to the door of the appliance or is attached to a hinge element of the door.

7. The tensioning system of claim 5, where the appliance is selected from an oven, a dishwasher, a refrigerator, a clothes dryer, and a freezer.

8. The tensioning system of claim 1, where the adjustment member is configured as a tensioning screw threadedly mounted through a portion of the first bracket, and further secured with at least one nut movably positioned to prevent movement of the tensioning screw in at least one direction when the nut is abutting the second bracket.

9. The tensioning system of claim 1, where the spring is configured as an extension spring.

10. The tensioning system of claim 1, where at least one lengthwise portion of the pull member is nearly parallel with the adjustment axis.

11. The tensioning system of claim 1, configured wherein operation of the adjustment member in a first direction along the adjustment axis increases the pull member tension, and operation of the adjustment member in a second direction along the adjustment axis decreases the pull member tension.

12. An adjustable spring-tension system for an appliance door, said system comprising:

a pull member including an expansion spring between a first pull member end and a second pull member end, where the first pull member end is configured for direct or indirect attachment to an appliance door and the second pull member end is configured for attachment to a base portion of an appliance;

a pulley including an external circumferential surface in contact with at least a lengthwise portion of the pull member between the first and second pull member ends, where the pulley is rotatably mounted in a channel of an inner bracket; and an outer bracket including a raceway defined on two sides by opposed walls, where the inner bracket is mounted in the raceway and is movable along a track in at least one of said opposed walls;

where movement of the inner bracket relative to the outer bracket is effected by operation of a threaded member contacting the outer bracket and abutting the inner bracket, and where a range of said movement is limited by a length of the track and by operation of the threaded member along a tension adjustment axis that is perpendicular to a rotation axis of the pulley.

13. The system of claim 12, where the pull member is disposed in tension between a first attachment to a door of an appliance and a second attachment to a body portion of the appliance, and where an axle of the pulley is movably disposed in the track.

14. The system of claim 13, configures such that operation of the threaded member in a first direction increases the tension, and operation of the threaded member in a second direction decreases the tension, each by changing an effective distance between the first attachment and the second attachment along the pull member.

15. The system of claim 12, where the pull member includes a chain, a wire, a polymer rope, a metal cable, a strap, a tape, or any combination thereof.

16. The system of claim 12, where the pull member includes a chain attached to a hinge member of an appliance door, and where the spring of the pull member is attached to a base portion of an appliance.

17. The system of claim 16, where the appliance is selected from an oven, a dishwasher, a refrigerator, a clothes dryer, and a freezer.

18. An oven including a door-tensioning system, said oven comprising:

a door mounted by a door hinge to an oven body;

where the door-tensioning system is disposed in the oven body, and the door tensioning system comprises:

a first bracket defining a raceway;

a second bracket disposed in the first bracket raceway, where the first bracket is movable relative to the second bracket, or the second bracket is movable relative to the first bracket, and said movability is mediated along an adjustment axis by an adjustment member attached to the first bracket and abutting the second bracket;

where a selected one of the first or second bracket that is not movable relative to the other of the first or second bracket is mounted to the oven body;

a pulley disposed in a raceway of the second bracket, where the pulley is rotatably mounted to one of the first bracket or the second bracket and is slidably attached to the other of the first bracket or the second bracket, where rotation of the pulley is around a pulley rotation axis orthogonal to the adjustment axis, and slidable movement of the pulley is along the adjustment axis; and a pull member, including a first pull member end attached to the door hinge opposite a second pull member end attached to the oven body, where the pull member includes an expansion spring providing tension between the first and second pull member ends and includes at least one pull member surface between the pull member ends, with said pull member surface contacting at least a portion of the pulley such that movement of the pulley along the adjustment axis in a first direction increases said tension and movement of the pulley along the adjustment axis in a second direction decreases said tension.

19. The oven of claim 18, where the pull member includes a chain nearer the first pull member end.

20. The oven of claim 18, wherein the adjustment member is threadedly engaged with the first bracket, and abuts the second bracket in a manner configured to move the second bracket along the adjustment axis when the adjustment member is rotated around the adjustment axis, which adjustment axis is orthogonal to the pulley rotation axis.

* * * * *